United States Patent [19]

Fujishima et al.

[11] 4,233,104

[45] Nov. 11, 1980

[54] AUTOMATIC WEB SPLICING AND FEEDING APPARATUS

[75] Inventors: Rikio Fujishima; Kunisuke Nishihara, both of Zama; Hideo Hosoi, Naritahigashi, all of Japan

[73] Assignees: Toshiba Kikai Kabushiki Kaisha; Dai Nippon Insatsu Kabushiki Kaisha, both of Tokyo, Japan

[21] Appl. No.: 71,692

[22] Filed: Aug. 31, 1979

[30] Foreign Application Priority Data

Sep. 8, 1978 [JP] Japan ..... 53/110320

[51] Int. Cl.[3] ..... B65H 19/08; B65H 19/18

[52] U.S. Cl. ..... 156/504; 242/58.1

[58] Field of Search ..... 156/504; 242/58.1, 58.2, 242/58.3, 58.4

[56] References Cited

U.S. PATENT DOCUMENTS

| | | | |
|---|---|---|---|
| Re. 17,843 | 10/1930 | Maston | 242/58.1 |
| 1,605,997 | 11/1926 | Stone | 242/58.1 |
| 1,895,425 | 1/1933 | Strand | 242/58.2 |
| 3,863,855 | 2/1975 | Gaubert | 156/504 |

*Primary Examiner*—Douglas J. Drummond

*Attorney, Agent, or Firm*—Koda and Androlia

[57] ABSTRACT

Apparatus for automatically splicing and feeding a web of paper, fabric or the like comprises a web feeder which includes a rotary shaft, web roll holding arms with their central portions fitted to the rotary shaft, lever members mounted on said rotary shaft on the outside of the arms to be substantially perpendicular thereto, an automatic web splicing device supported by the lever members, and a device for driving the rotary shaft so as to move the arms to a working position. The apparatus further comprises a festoon loop type web storing device and an electric mechanism for determining direction and angle of rotation of the rotary shaft. The web splicing device includes web nip rollers and a cutting device for cutting the web after bonding the trailing end of a preceding web to the leading end of a succeeding web.

9 Claims, 19 Drawing Figures

AUTOMATIC WEB SPLICING AND FEEDING APPARATUS

BACKGROUND OF THE INVENTION

This invention relates to an automatic web splicing and feeding apparatus for feeding a web of paper, fabric or the like from a web pay out roll to a web working machine such as a rotary press or a web coater without reducing the speed of feeding the web to the web working machine at a time when a web wound about one web pay out roll is spliced to that of the other web pay out roll.

Generally, the prior art automatic web splicing and feeding apparatus can be classified into a stationary type apparatus and a pre-drive type apparatus.

In the stationary type apparatus, a web of one web roll which has been payed out is stopped at a web splicing position where a next new web is to be spliced to the trailing end of the first mentioned web. Prior to this operation, since the web roll is held at a stationary position remote from the splicing position, a shaft is inserted into a central hole of the new web roll and the both ends of the shaft projecting beyond the hole are lifted by using a hoist or the like, to a working or pay out position while observing the position of the web roll with the eyes of an operator. After mounting the web roll to the working position, and starting the feeding of the web, when the diameter of this web roll is reduced to a predetermined value, the web is stopped to splice its trailing end with the leading end of the new web. At this time the leading end is coated with an adhesive and bonded to the trailing end of the stopped web. After bonding the web of the old web roll is cut and feeding of the new web to a web working machine such as a rotary press or a web coater is commenced. In this manner, the web is continuously spliced and fed.

However, this stationary type apparatus accompanies the following defects. (1) It is a hard labour and dangerous for workers to insert a shaft into the central hole of the web roll and lift it to the working position. (2) It is considerably difficult to automatically mount the web roll to the working position. (3) The use of a lifting device such as a hoist requires more work which reduces working efficiency. (4) It is dangerous to raise the new web roll to the working position located at a considerably high level.

On the other hand, in the pre-drive type apparatus which includes two or three rotatable arms, when it is required to mount a new web roll, these arms are rotated to the position above the web roll laid on a web lifting device and the lifting device is then raised to attach the web roll to the arms. Thereafter, the arms are rotated to a web splicing position for splicing the web now being payed out with the leading end of a new web and the new web roll is then pre-driven until the peripheral speed of the new web roll comes to coincide with the feeding speed of the web now being payed out. Upon coincidence of these speeds, the leading end of the new web coated with an adhesive is press bonded to the trailing end of running web and the remainder of the running web is cut thereby continuously feeding the new web to the working machine.

However, this pre-drive type apparatus also accompanies the following defects. (1) It is necessary to use a device for coinciding the peripheral speed of the new web roll with the feeding speed of the web of the preceding or running web. (2) There is a fear of failing in web splicing if a web roll is not in a perfect cylindrical form or its surface is wavy due to the condition of storage. (3) There is a fear of getting loose the new web roll in the pre-drive operation. (4) Since the arms are rotated while the web is fed to the web working machine, a slip ring has to be used for feeding power to electric devices contained in the arms. Moreover, the construction of the apparatus is complicated because it is necessary to use a pneumatic source for driving an air cylinder and a rotary joint for cooling water, and the maintenance of these elements requires troublesome works.

SUMMARY OF THE INVENTION

Therefore, an object of this invention is to obviate the defects of the prior art described above and to provide an improved automatic splicing and feeding apparatus capable of easily mounting a new web roll onto the apparatus and safely performing web splicing work with high efficiencies.

According to this invention, there is provided an automatic web splicing and feeding apparatus of the type wherein the trailing end of a preceeding web is bonded to the leading end of a succeeding web and the bonded webs are stored in a web storing device and then fed to a web working machine, and characterized in that there is provided a web feeder which comprises supporting members, a rotary shaft with both ends rotatably supported by the supporting members, a pair of spaced apart web roll holding arms with their central portions fitted to the rotary shaft, two pairs of push members secured to opposing surfaces of the arms at portions near the extreme ends thereof for detachably holding both ends of two web rolls, lever members mounted on the rotary shaft on the outside of the arms, an automatic web splicing device supported by the lever members for bonding the trailing end of the web of one of two web rolls to the leading end of the web of the other web roll, a driving device for driving the rotary shaft so as to move one of two pairs of push members to a working position, and a device for determining direction and angle of the rotary shaft.

DESCRIPTION OF THE PREFERRED EMBODIMENT

Figure 1:
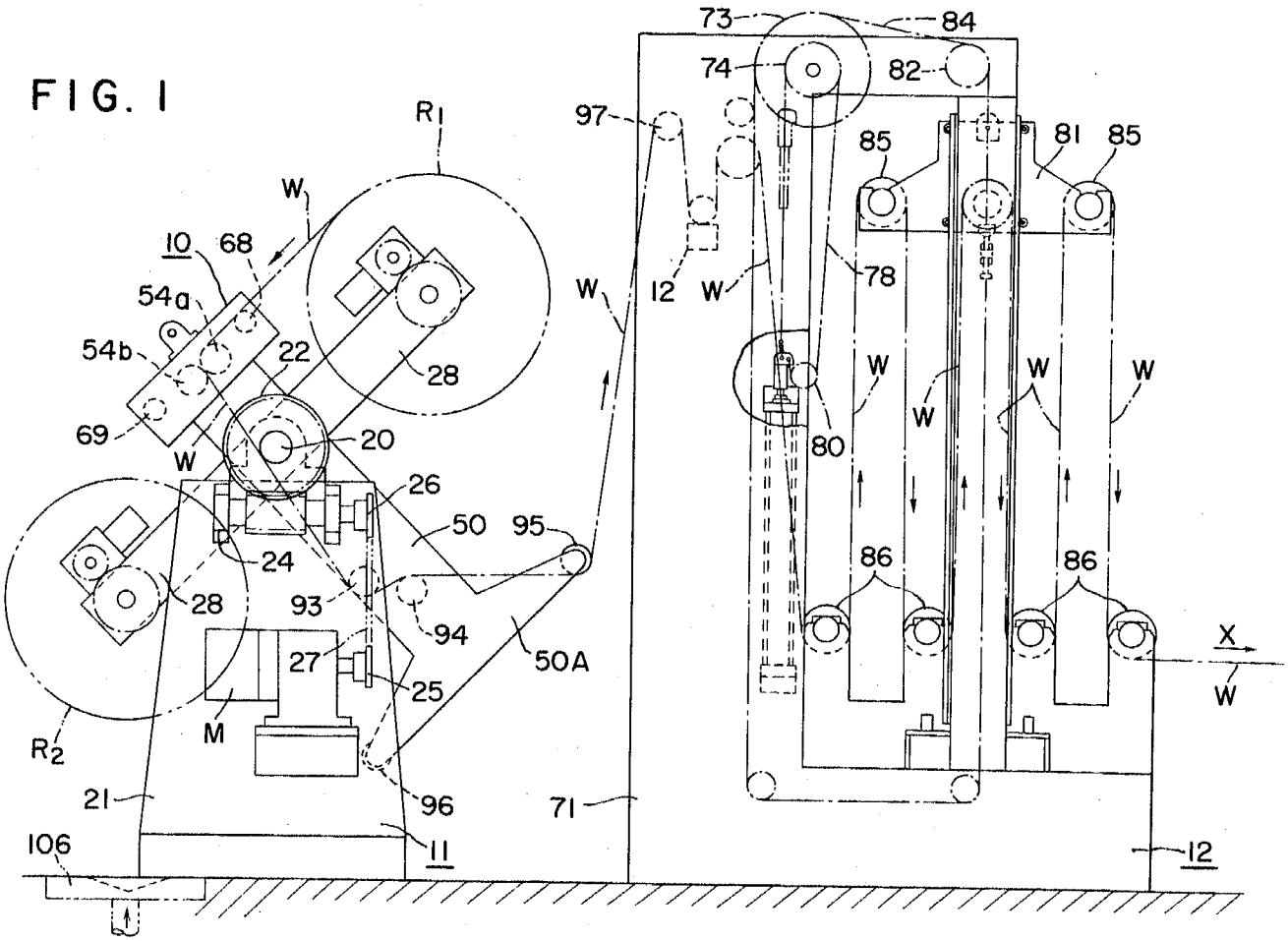
FIG. 1 is a schematic side view showing an automatic web splicing and feeding apparatus according to this invention.

FIG. 1 is a general view showing an automatic web splicing and feeding apparatus of this invention comprising a web feeder 11 on which a web splicing device 10 is mounted and a festoon loop type web storing device 12. Web rolls R1 and R2 are supported by the web feeder 11 by suitable means to be described hereinafter. A web W payed out from one of web rolls R1 and R2 passes through the web splicing device 10, and is caused to run through the web storing device 12 in a zig-zag fashion as shown by dot and dash line in FIG. 1. The web is then fed to a web working machine such as a rotary press or a web coater, not shown, in a direction designated by an arrow X. When nearly all of the web W on the web roll R1, for example, has been payed out, a web on the other web roll R2 is payed out and the leading end thereof is bonded to the trailing end portion of the web being payed out from the web roll R1. This bonding is performed by the web splicing device 10 in a manner to be described hereinafter. During the feeding of the web from web roll R2, another web roll R3, not shown in FIG. 1, is exchanged with the empty web roll R1 at the time when nearly all of the web of the roll R2 has been payed out.

Although the construction and the operation of the web splicing and feeding apparatus according to this invention have been briefly described hereinabove, details thereof will now be described in the followings.

First, the web feeder 11 including the web splicing device 10 will be described in conjunction with left half of FIG. 1 and FIGS. 2 and 3. In these figures, a worm wheel 22 attached to one end of a rotary shaft 20 rotatably supported by a pair of opposing pedestals 21 meshes a worm 23 which is rotatably journalled by bearings 24 secured to the outer surface of the pedestal 21. The worm 23 is operatively connected to a drive motor M installed on one side of one of the pedestals 21 through a transmission mechanism which comprises a sprocket wheel 25 attached to the motor shaft, a sprocket wheel 26 secured to the shaft of the worm 23 and an endless chain 27 passed about these sprockets wheels. Thus, the worm 23, i.e. the rotary shaft 20, is driven by the motor M.

A pair of opposing web roll holding arms 28 are fitted to the rotary shaft 20 to be slidable along the shaft 20 at the central portions of the arms 28. These arms 28 engage rack keys 29 secured to the shaft 20 through movable pinions 30 provided with shanks which are accommodated in the openings of the arms 28, so that the arms 28 can slide towards or apart from each other on the shaft 20 as the pinions 30 rotate, whereby the distance between these opposing arms 28 can be adjusted in accordance with the width of the web rolls R1 and R2 to be disposed between the arms 28.

The piston rods 30*a* of air piston-cylinder assemblies C1 and C2 attached to the arms 28 are connected to racks 31 which engage first pinions 35 rotatably supported by the arms 28, respectively. Push members 32*a* and 32*b* are inserted into the right hand ends (in FIG. 2) of hollow shafts R1*a* and R2*a* and supported to be rotatable by movable sleeves 33 through bearings 33A, at portions near the extreme ends of the arm 28, respectively. The movable sleeves 33 are slidably fitted to the arms 28 through key members 33B attached to the arms 28, and racks 34 formed on the sleeves 33 engage second pinions 37 mounted on the shafts 36 of the first pinions 35. Therefore, for example, when the piston rod 30*a* of the air piston-cylinder assembly C2 projects and engages the rack 31, the movable sleeve 33 is moved leftwardly in FIG. 2 in accordance with the movement of the rack 31 through the pinions 35 and 37, and the push member 32*b* is inserted into the hollow shaft R2*a* of the web roll R2 and supports it at one side thereof. The transmission mechanism connecting the air piston-cylinder assembly C2 with the push member 32*b* operates reversibly, so that when a motor M2, described hereinafter, operates, the push member 32*b* can move forwardly (i.e. leftwardly in FIG. 2) or backwardly against the operating force of the piston-cylinder assembly C2. The movable member 33 is provided at its one end with an electromagnetic braking member 38*b* (38*a* with the assembly C1) into which the end of the shaft of the push member 32*b* extends. The electromagnetic braking member 38*b* is used for applying tension to the web W of the web roll R2 which is fed to a working machine such as a rotary press, and a predetermined braking force is applied to the braking member 38*b* (38*a*) by the feedback from a tension detecting roller 98 described later.

A push member 39*b* which is inserted into the other end (left end in FIG. 2) of the hollow shaft R2*a* of the web roll R2 to support the same is rotatably attached to a movable sleeve 40 through a bearing 40A. The movable sleeve 40 is slidably fitted through a key 40B to one arm 28 opposing the other arm 28 which supports the sleeve 33. Screw threads 40C formed on a shaft attached to the sleeve 40 engage a gear 45 which is rotatably supported by bearings 42 accommodated in a gearing box 41 which is attached to the arm 28. The motor M2 is fixed to the arm 28 with its output shaft connected to a gear wheel 43 which is meshed with a gear wheel 45. Limit switches LSC1, LSC2, LSA and LSB are attached to the rotary shaft 20 and the operation of these limit switches will be described hereinafter.

In the foregoings although the construction and operation regarding the web roll R2, i.e. air piston-cylinder assembly C2 have been described, it will be of course understood that the construction and the operation regarding the web roll R1, i.e. air piston-cylinder assembly C1 are substantially the same as those of the web roll R2.

A pair of T-shaped levers 50 are secured to the rotary shaft 20 adjacent to and substantially perpendicularly to the respective arms 28. To one end of each lever 50 is attached the web splicing device 10, and the other end thereof is formed with a beam 50A (see FIG. 1). The opposite ends of the beam 50A are provided with web guide rollers 95 and 96, respectively. Web guide rollers 93 and 94 are mounted on the lever 50 near the beam 50A. The web W is guided from the web splicing device 10 to the web storing device 12 through these guide rollers 93, 94, 95 and 96 in a manner to be described later.

Referring now to FIGS. 4 through 7, the web splicing device 10 comprises a frame 52 which rotatably supports the opposite ends of parallel shafts 51 through bearings 53 attached to the frame 52. The axis of each shaft 51 is eccentric by a distance e with respect to a journalled portions 51A disposed at both ends of the shaft 51. Nip rollers 54*a* and 54*b* are mounted on the shaft 51 through bearings 55, and each nip roller 54*a* (54*b*) is surrounded by a rubber tube 56A provided with a series of perforations 56 for attracting the web W by vacuum. The interior 57 of the nip roller 54*a* (54*b*) is sealed at both ends by sealing means, not shown, and a hole 58 provided for the shaft 51 is communicated with an evacuating device, not shown, for the purpose of attracting the web onto the surface of the nip roller 54*a* (54*b*) through the perforations 56. The other end of the shaft 51 projecting beyond the frame 52 is firmly connected to a connecting member 59 which is coupled through a pin 61 to the piston rod 60 of a piston-cylinder assembly C3 (C4), one end of which is pivotally supported by the frame 52.

Levers 63 are secured to both ends of the shaft 51 to support knives 62*a* and 62*b* each having a sawtooth edge arranged in parallel with the longitudinal axes of the nip rollers 54*a* (54*b*).

A pipe 64 is rotatably coupled to levers 66 journalled by bearing brackets 65 secured to the frame 52. The pipe 64 has a portion rectangular in cross section, on which the web W passes, and this portion is provided with a plurality of perforations 64*a* in the longitudinal direction which are communicated to an evacuation device, not shown, for preliminarily attracting the end of the web W to be applied with an adhesive. The end portions of the pipe 64 are circular in cross section and attached to the levers 66 which are rotatable with respect to the bearings 65 secured to the frame 52. A handle 66A is attached to one of the levers 66, and a brush 67 is supported between the levers 66 in parallel with the pipe 64. The brush 67 is moved to one of the knives 62*a* and 62*b* by rotating the handle 66A to support when the web W now being payed out is to be cut after the web has been spliced with a new web. Guide rolls 68 and 69 for guiding the webs of the web rolls R1 and R2 are rotatably supported by the frame 52, and a brake member 70 made of an eccentric rubber ring and attached to the bearing brackets 65 presses the side surface of the nip roller 54*a* (54*b*) for maintaining the position of the nip roller when the web W is attracted to the nip roller 54*a* for splicing the web W.

Figure 8:
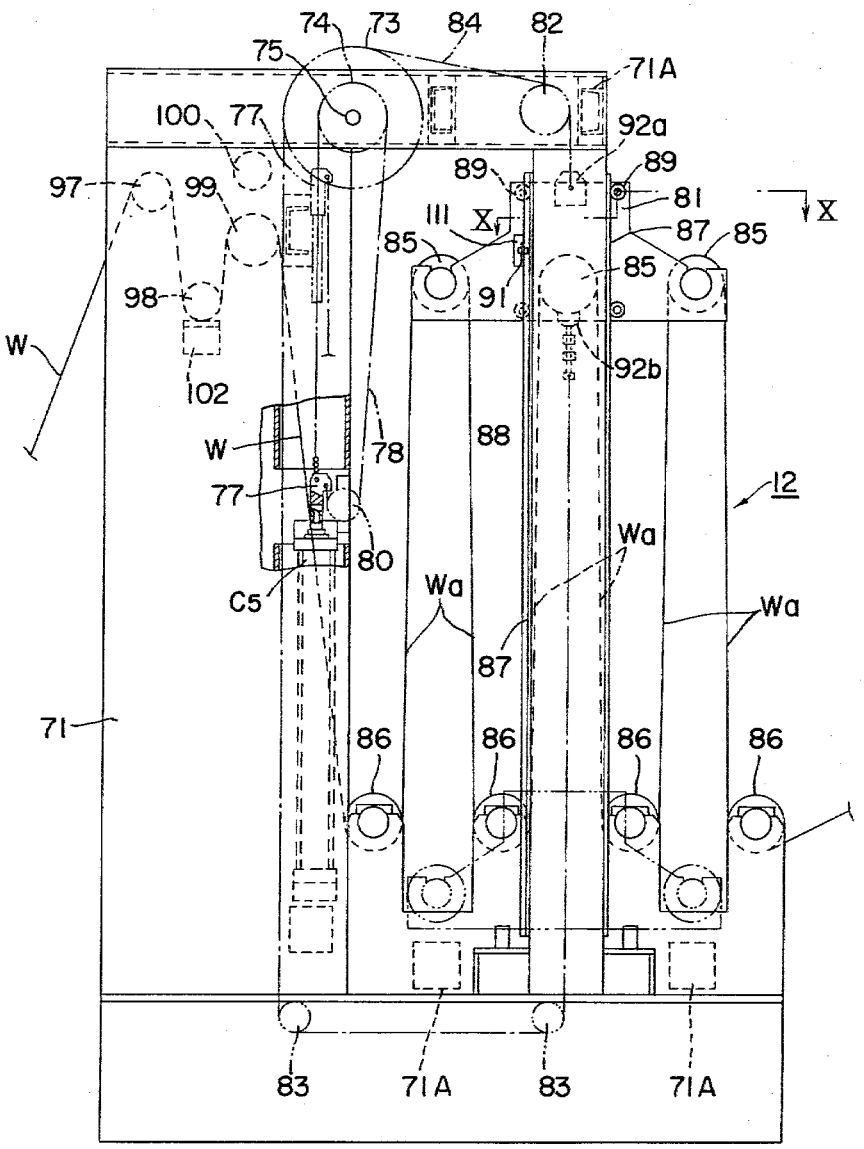
FIG. 8 is a side view of a web storing device of the web splicing and feeding apparatus shown in FIG. 1.
Figure 9:
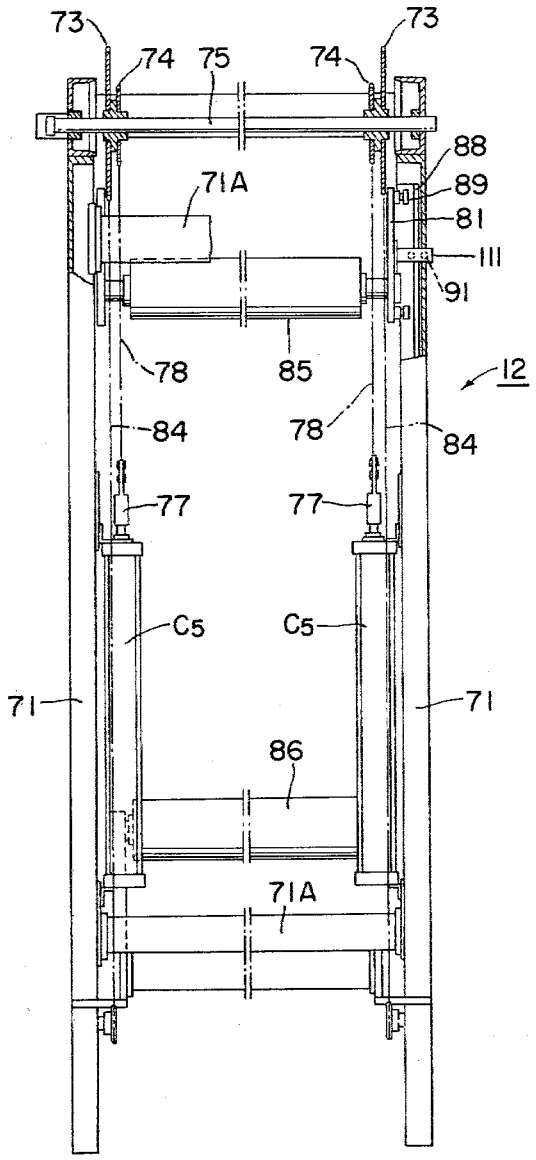
FIG. 9 is a front view of the web storing device shown in FIG. 8.
Figure 10:
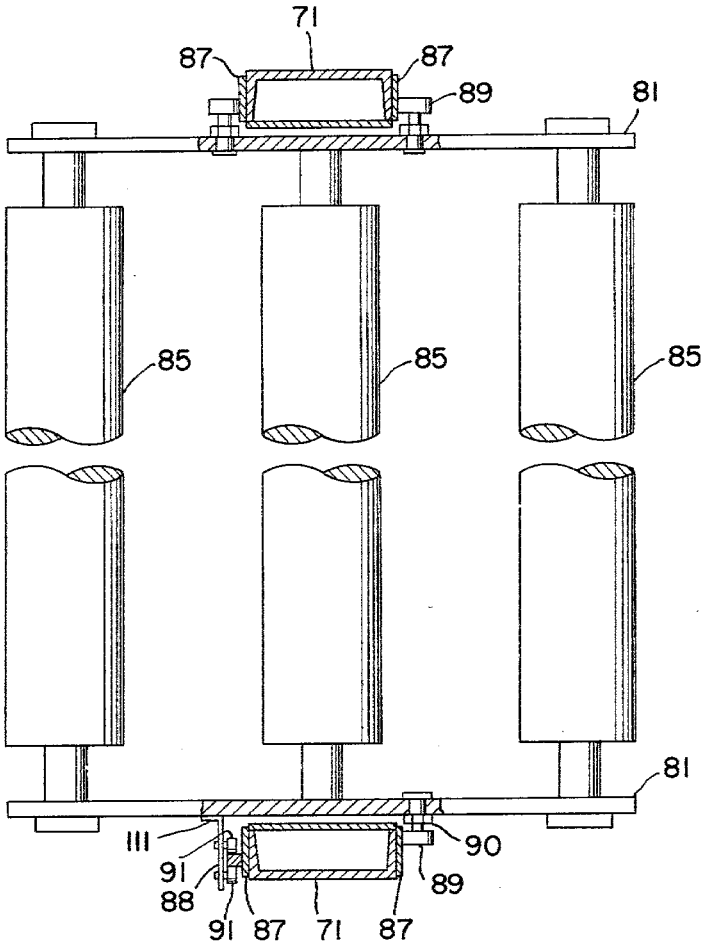
FIG. 10 is a cross sectional view taken along the line X—X shown in FIG. 8.

FIGS. 8 through 10 show the details of the festoon-type web storing device 12, in which a pair of guide members 71 are held spaced apart by stays 71A. The web storing device 12 includes a plurality of web festoon loops Wa for storing a large quantity of web and the web runs through the festoon loops Wa about four guide rollers 86 which are rotatably journalled in the lower portions of the guide members 71 and three dancing rollers 85 rotatably attached to a movable member 81 which moves vertically towards or apart from the guide rollers 86. The movable member 81 moves upwardly together with dancing rollers 85 so as to be separated from the guide rollers 86 when the web is fed into the web festoon loops Wa at a feeding rate higher than that when the web is fed into the web working machine, and when the feeding rate of the web W into the web working machine from the web festoon loops Wa exceeds the rate at which the web is fed into the festoon loops Wa, the movable member 81 moves downwardly towards the guide rollers 86. Parallel guide members 87 and 88 are secured to the pair of guide members 71 for smoothly moving the movable member 81 upwardly or downwardly. Follower rollers 89 are rotatably supported by shafts secured to the movable members 81 by means of nuts 90 so as to closely contact the guide members 87 so that the movable members 81 are kept in planes vertical to the axes of the dancing rollers 85.

Followers 91 are attached to the movable member 81 through a bracket 111 so as to clamp the guide member 88 to prevent the movable member 81 from moving in a direction parallel to the axis of the dancing roller 85.

Reference numeral 84 designates a pair of chains and the both ends of each chain 84 are secured respectively to suspension members 92*a* and 92*b* attached to the upper and lower portions of the movable member 81 and the chains are passed around sprocket wheels 82 and 83 which are rotatably supported by the guide members 71, thereby constituting a closed loop. The chains 84 are further passed around large sprocket wheels 73 which are fixed to a shaft 75 rotatably supported by the supporting members 71 at their upper portions and are driven by a pair of piston-cylinder assemblies C5. The movable member 81 is moved upwardly by the action of the piston-cylinder assemblies C5 located inside of the guide members 71 as shown in FIG. 8.

Chains 78 are passed about sprocket wheels 80 rotatably supported by the guide members 71 and about small sprocket wheels 74 integral with the large sprocket wheels 73. The both ends of each chain 78 are fixed to connecting member 77 which is secured to the piston rod of each piston-cylinder assembly C5. Thus, when the connecting members 77 are lowered to the position shown by solid lines from the position shown by phantom lines in FIG. 8 by the action of the piston-cylinder assemblies C5, the sprocket wheels 73 and 74 are counter-clockwisely rotated through the chains 78 thereby to upwardly move the movable member 81 through the chains 84. At this time, the dancing rollers 85 are raised, so that the festoon loops Wa are extended vertically and an additional amount of web W can be stored in the web storing device 12.

The web W entering from the web feeder 11 into the web storing device 12 passes about a guide roller 97 rotatably supported by the guide members 71 and the tension detecting roller 98 described before. An accelerator 99, in the form of a roller, is positioned downstream of the roller 98 and rotated by an accelerating motor, not shown. Above this accelerating roller 99 is located a nip roller 100, which is moved downwardly by piston-cylinder means, not shown, so as to contact it with the accelerating roller 99, whereby the web W fed from the web roll R1 (R2) is accelerated until a predetermined quantity of webs is stored in the web festoon loops Wa in the festoon type web storing device 12.

A web roll lifter 106, in FIG. 1, is disposed below the position at which a web roll is secured to the arms 28 of the web feeder 11 and the web roll laid on the lifter 106 is raised to the working position described above.

The operation of the web splicing and feeding apparatus according to this invention will be described hereunder in conjunction with FIGS. 11 through 14.

Figure 11:
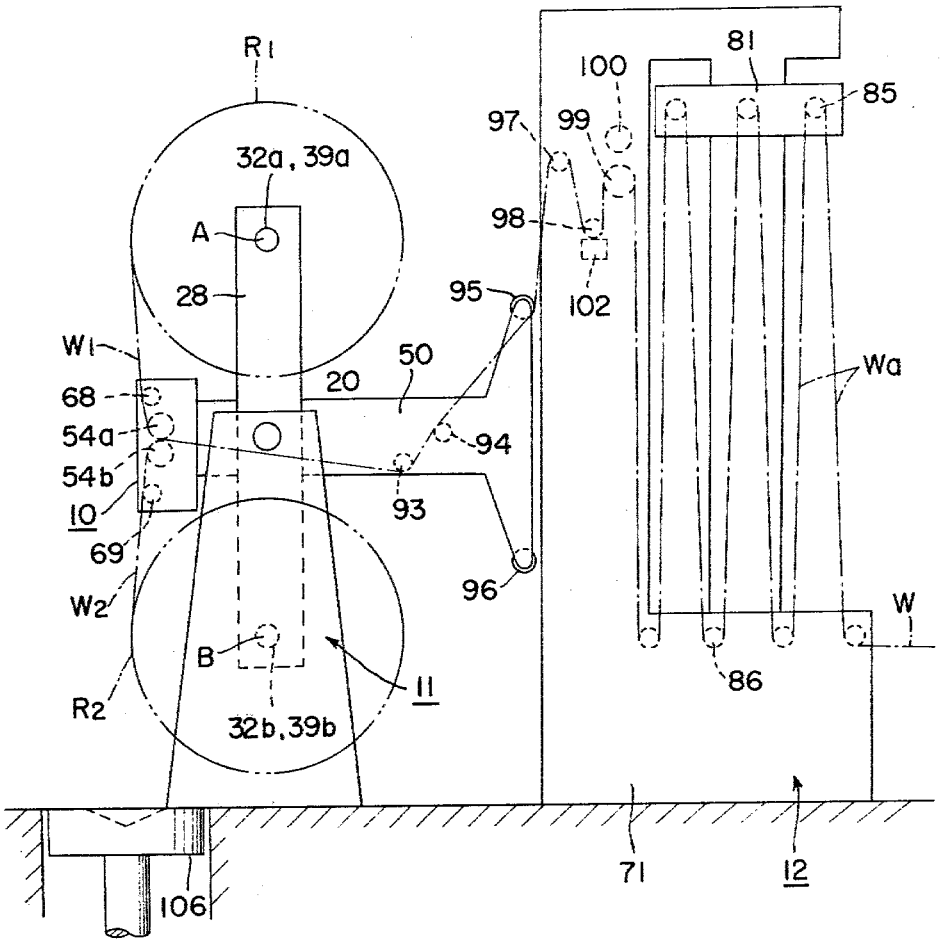
FIGS. 11 through 13 are schematic views showing the web splicing and feeding apparatus of this invention and useful to explain the operation thereof.

FIG. 11 shows a state in which the web arms 28 for supporting the web rolls R1 and R2 are in their vertical positions. In this state, when it is required to mount the web rolls R1 and R2 on the arms 28 at first, the motor M shown in FIG. 2 is driven, thereby to counter-clockwisely rotate the arms 28 so that the push members 32*a* and 39*a* are moved away from the position designated by character A in FIG. 11 to the position designated by character C in FIG. 12 and when the push members 32*a* and 39*a* reach the position C, the motor M is stopped. The web roll lifter 106 then operates to raise the web roll R1 laid thereon by a distance such that the center E of the hollow shaft R1*a* of the web roll R1 reaches the position A while the operator observes the coincidence of the hollow shaft R1*a* with the push members 32*a* and 39*a*. It is of course necessary to adjust the distance between the both arms 28 in accordance with the width of the web roll R1 (R2).

Upon coincidence of the position of the axis of the shaft R1*a* with the push members 32*a* and 39*a*, the piston-cylinder assemblies C1 is actuated to advance (leftwardly in FIG. 2) the movable sleeves 33 through the racks 31 and first and second pinions 35 and 37 to insert the push members 32*a* and 39*a* into the hollow shaft R1*a* of the web roll R1. Thus, the web roll R1 is supported by the arms 28.

Figure 12:
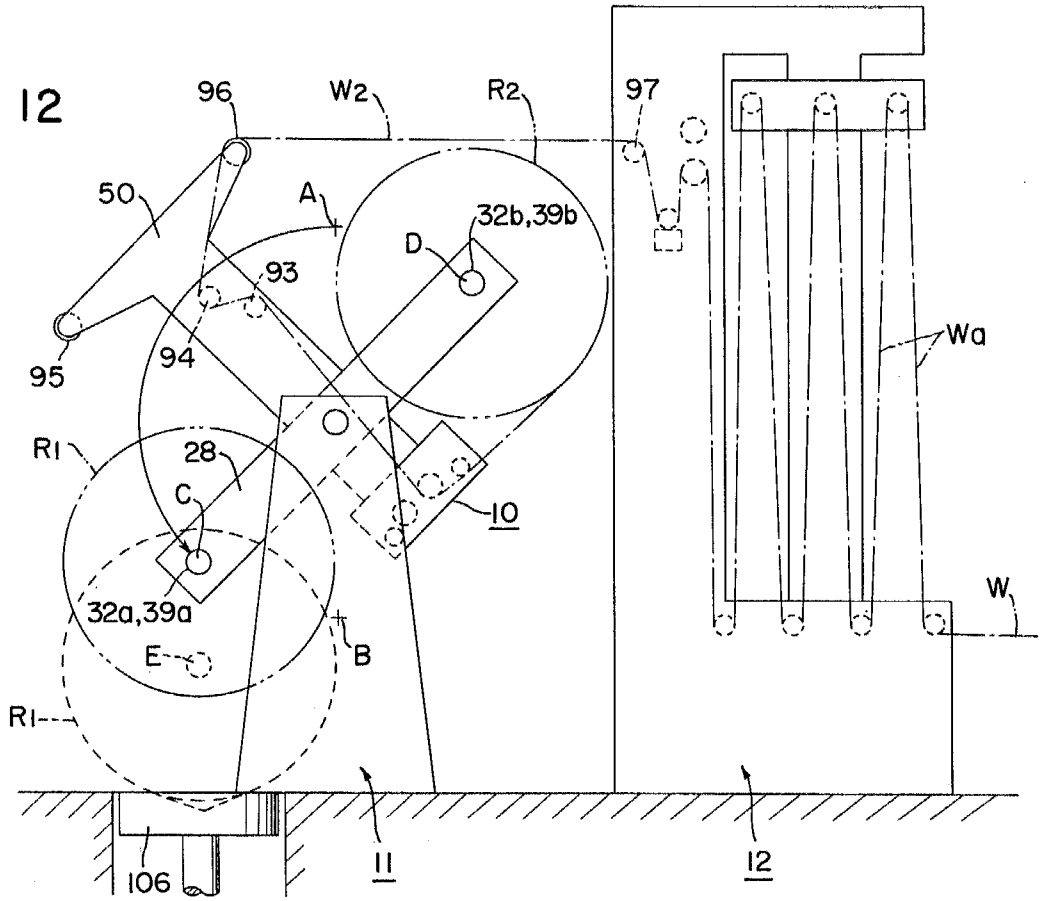

The motor M is then driven again to clockwisely rotate the arms 28 to the position where the point C comes to coincide with the point A in FIG. 12 and the point D, i.e. push members 32*b* and 39*b*, moves to the point B.

When it is required to mount the web roll R2, the arms 28 are clockwisely rotated to move the point B, i.e. push members 32*b* and 39*b* to the point C. Upon reaching the point C, the motor is stopped and the web roll lifter 106 on which the web roll R2 has been laid is raised to the position where the hollow shaft R2*a* of the web roll R2 coincides with the axes of push members 32*b* and 39*b*. Then, the air piston-cylinder assemblies C2 are attracted to insert the push members 32*b* and 39*b* into the hollow shaft R2*a* thus supporting the web roll R2.

After the lifter 106 has been lowered, the arms 28 are rotated counter-clockwisely so as to move the point C, i.e. push members 32*b* and 39*b*, to the point B. An electric control mechanism for clockwisely or counter-clockwisely rotating the arms 28 will be described hereinafter in conjunction with FIG. 15.

Where the web W1, in FIG. 11, wound about the web roll R1 is guided to the web storing device 12 through the guide roller 68, nip roller 54*a* which is maintained not to cooperate with the other nip roller 54*b* at this time, guide rollers 93, 94, 95 and 97, tension detecting roller 98, and accelerating roller 99 and then fed into a web working machine, not shown, suppose now that the web W1 of the web roll R1 has been nearly completely payed out, and that the diameter of the web roll R1 has been reduced. When the diameter thereof reaches a predetermined value, the feeding of the web W1 is stopped by the braking force applied by the electromagnetic braking member 38*a* of the web feeder 10 in response to a signal generated by a web diameter detector, not shown. At the same time, the nip roller 100 is lowered to nip the web W1 between the nip roller 100 and the accelerating roller 99 to completely stop the running of the web W1, but the running of the web in the web festoon loops Wa is not stopped because the movable member 81 lowers and the web in the web storing device 12 is continuously fed to the web working machine.

Figure 14A:
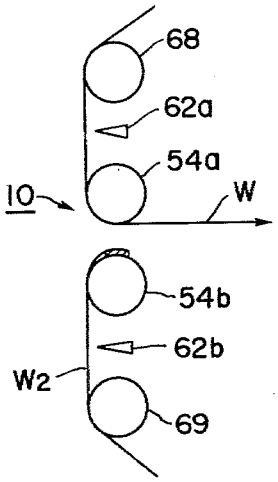
FIGS. 14A through 14E are diagrams useful to explain the web splicing operations of the web rolls.
Figure 14B:
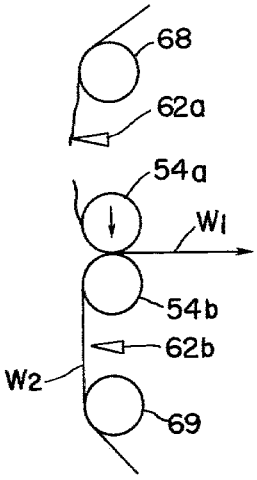

In the meantime, the web W2 of roll R2 with its leading end applied with the adhesive is brought near the position where the web splicing will be carried out and the leading end is firmly attracted by the nip roller 54*b* of the web feeder 10 as shown in FIG. 14A. Upon stoppage of the feeding of the web W1 of the web roll R1, the nip roller 54*a* is pressed against the nip roller 54*b* by piston-cylinder means C4 shown in FIG. 4 and the leading end of the web of roll R2 is bonded to the trailing end portion of the web W1. The remaining portion of the web W1 is then cut by the knife 62*a* which has been rotated by the piston-cylinder means C3. This state is shown in FIG. 14B. Thus, the web W2 is ready for being continuously fed to the web working machine.

Figure 14C:
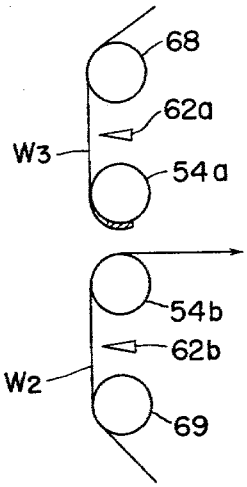

Thereafter the nip roller 54*a* is returned to the original position by the operation of the piston-cylinder means C3 as shown in FIG. 14C and the feeding of the web W2 from the web roll R2 begins. At the time when the nip roller 54*a* is returned to the original position, the accelerating roller 99 is driven by an accelerator, not shown, and the web W2 is fed at an accelerated speed until the predetermined quantity of web W2 of the web roll R2 is stored in the festoon loops Wa of the web storing device 12. Upon reaching the predetermined quantity, the acceleration is stopped and thereafter the web feeding speed is under the control of the web tension detector 102. Thus, during the splicing of the webs W1 and W2 the web is continuously fed into the web working machine at a constant speed by the operation of the festoon loops Wa and the mechanism including the movable member 81 in the web storing device 12.

After completion of the feeding of the web W1, and when the feeding of the web W2 is commenced, the arms 28 are counter-clockwisely rotated by the operation of the motor M to the position designated by point C from the point A to exchange the used web roll R1 with a new web roll R3. FIG. 12 shows a state in which the web roll R1 has been rotated from point A to point C which is positioned on the extention of the vertical center line of the web roll lifter 106. Under these conditions, the piston-cylinder assemblies operate to draw back the piston rods 30*a* thereby to disengage the push members 32*a* and 39*a* from the hollow shaft of the web roll R1. The lifter 106 now supporting the new web roll R3 is raised to the position C where the hollow shaft of the web roll R3 coincides with the push members 32*a* and 39*a*. Then, the air piston-cylinder assemblies C1 operate to move the movable sleeves 33 thereby to support the web roll R3 by the push members 32*a* and 39*a*.

When the web roll R1 is rotated to point C from point A, the web roll R2 is moved to point D from point B as shown in FIG. 12, so that during the rotation of the web roll R2, the web W2 departs from the guide roller 95 and moves to the guide roller 96 and the web W2 is fed to the web storing device 12 through guide rollers 93, 94, 96 and 97. For the reason described above, it is desired to position the guide rollers 96 and 97 so that the web-pass-line between these rollers 96 and 97 will not contact the web roll R2 even when its diameter is a maximum during the rotation of the web roll R2 from point B to point D.

After bringing the web roll R3 to point C, the arms 28 are clockwisely rotated by the motor M to move the new web roll R3 to point A from point C and the web roll R2 is moved to point B. Under this positional relationship, the leading end of the web W3 of roll R3 is attracted by the nip roller 54*a* and kept in this position to prepare for the next web splicing operation as shown in FIG. 14C.

Figure 2:
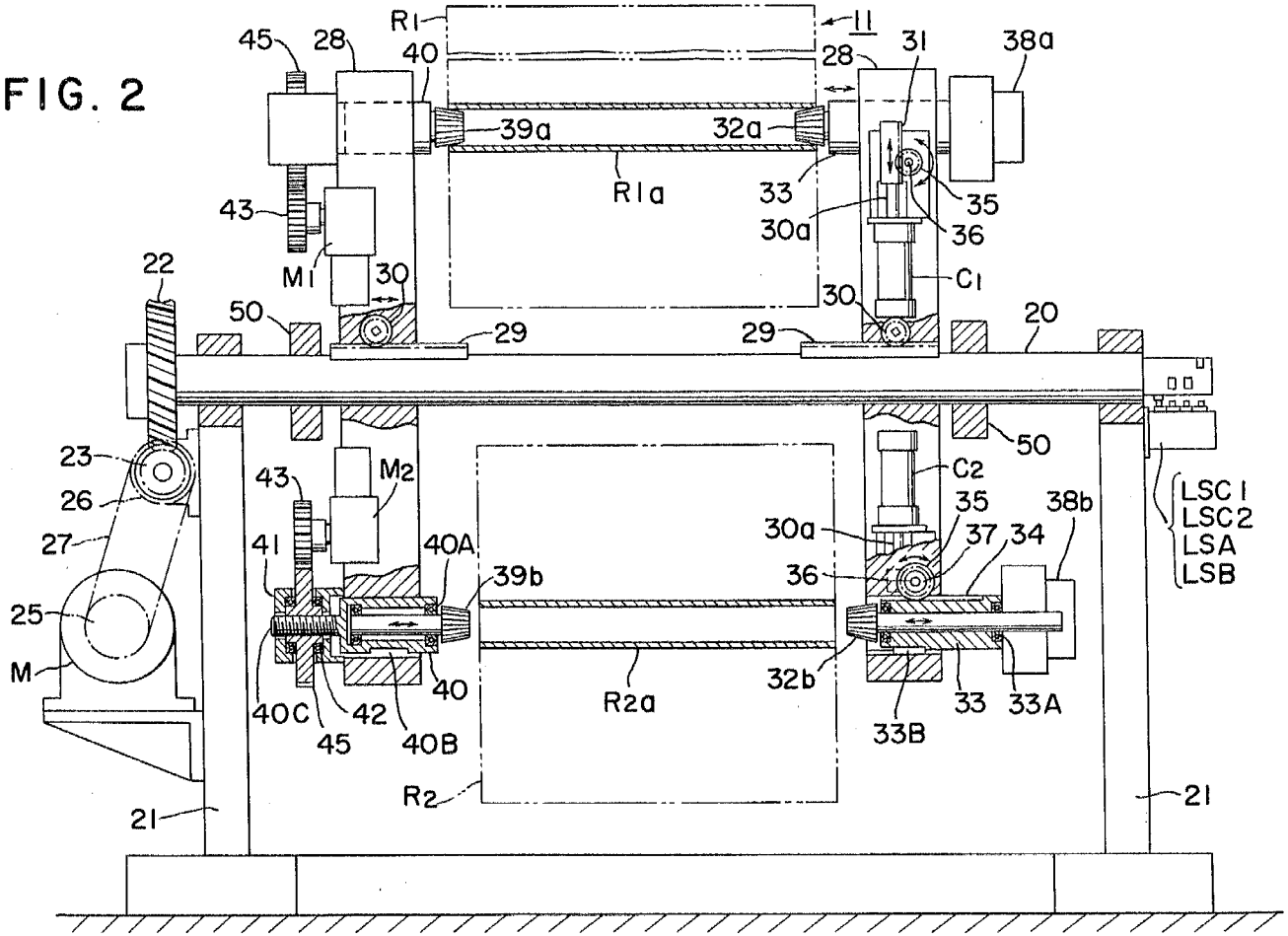
FIG. 2 shows a front view, partially in longitudinal section, of a portion adapted to support web rolls of the web splicing and feeding apparatus shown in FIG. 1.
Figure 3:
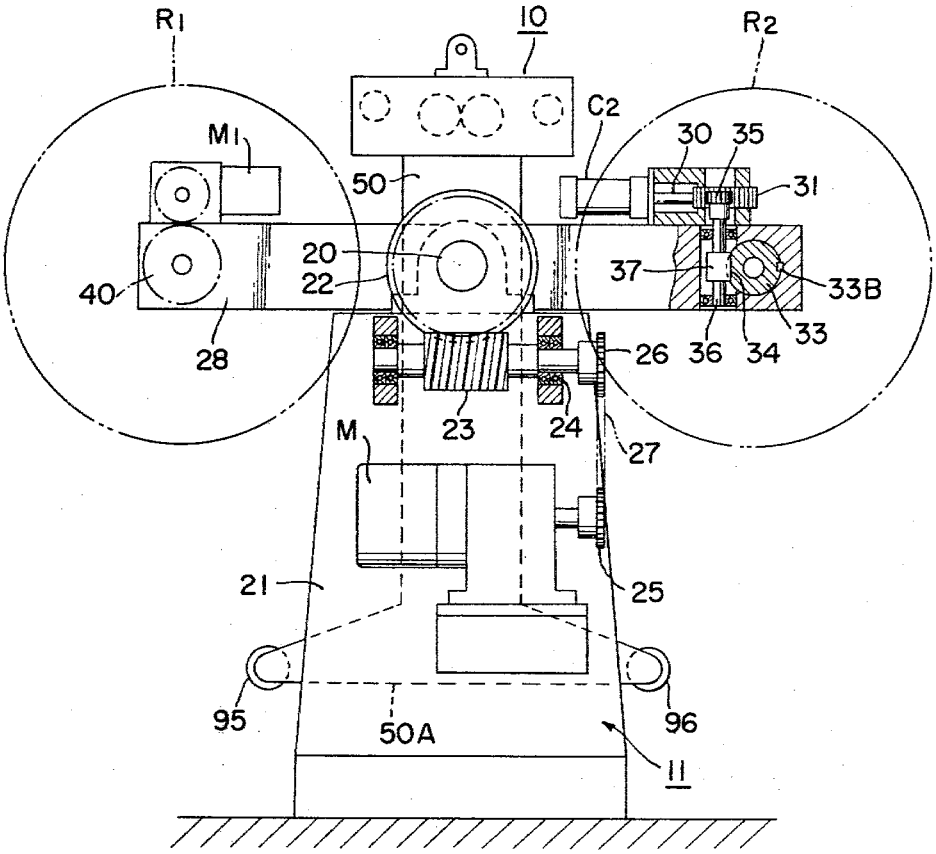
FIG. 3 shows a side view, partially in cross section, of the portion shown in FIG. 2, but at a position rotated by 90° from that shown in FIG. 2.
Figure 4:
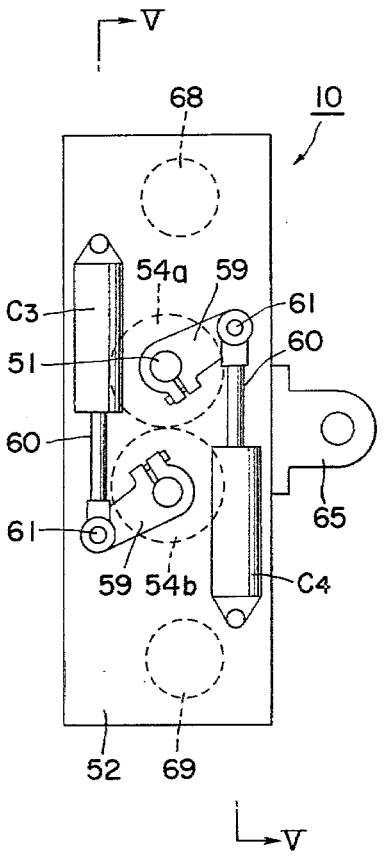
FIG. 4 is a side view showing the automatic web splicing device of the automatic web splicing and feeding apparatus shown in FIG. 1.
Figure 6:
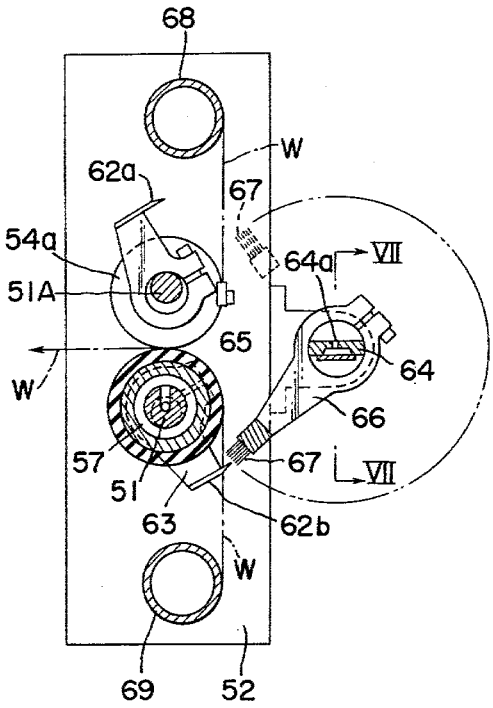
FIG. 6 is a cross sectional view of the web splicing device taken along the line VI—VI shown in FIG. 5.
Figure 5:
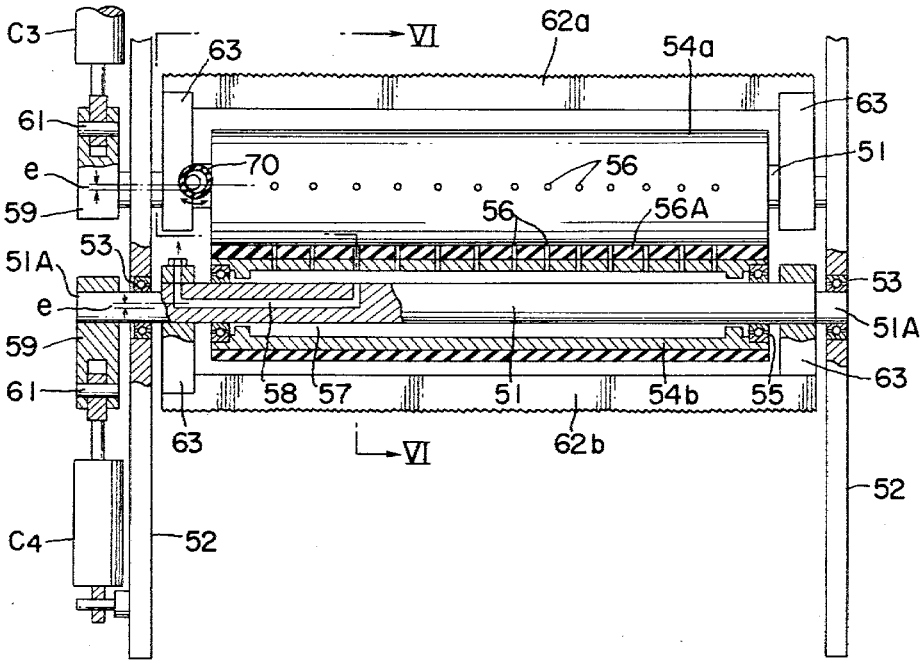
FIG. 5 is a longitudinal sectional view of the web splicing device taken along the line V—V shown in FIG. 4.
Figure 7:
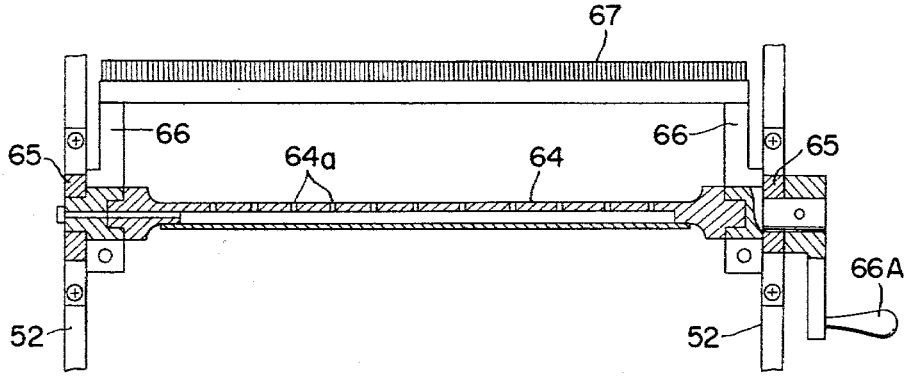
FIG. 7 is a longitudinal sectional view of the web splicing device taken along the line VII—VII shown in FIG. 6.

In the meantime, when the diameter of the web roll R2 reduces to a predetermined value during the web feeding operation, the running of the web W2 is stopped by the braking force applied by the electromagnetic braking member 38*b*, in FIG. 2, in response to a signal generated by a web diameter detector, not shown. At the same time, the nip roller 100 is lowered to nip the web W2 between the nip roller 100 and the accelerating roller 99, but the web W2 running in the web loop Wa would not be stopped and continuously fed into the web working machine in a manner described hereinbefore in connection with the operation of the web roll R1.

Figure 14D:
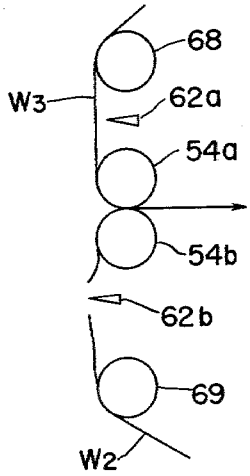

The leading end of web W3 coated with an adhesive is bonded to the web W2 now being payed out. More particularly, when the feeding of the web W2 is stopped, the piston cylinder means C3 immediately operates to press the nip roller 54*b* engaging the web W2 against the nip roller 54*a* engaging the leading end of the web W3. Thus, the web W2 is bonded to the web W3, and at the same time the knife 62*b* is rotated by the operation of the piston cylinder means C3 to cut the web W2 as shown in FIG. 14D.

Figure 14E:
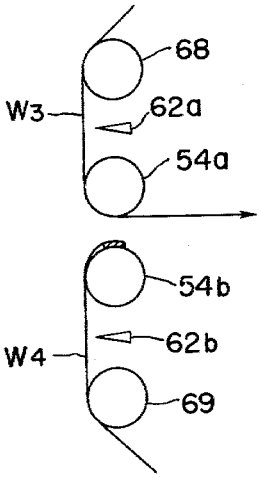

At the next step shown in FIG. 14E, when the nip roller 54*b* is returned to its original position, the feeding of web W3 is commenced. Simultaneously, the accelerating roller 99 operates to accelerate the feeding speed of the web W3 in cooperation with the nip roller 100 until a predetermined quantity of the web W3 has been stored in the web storing device 12. When the quantity of the web W3 reaches the predetermined quantity, the acceleration is stopped and the web W3 is continuously fed under the control of the web tension detector 102. During these operations, the web running in the web loop Wa in the web storing device 12 is continuously fed therefrom to the web working machine at a constant speed.

Figure 13:
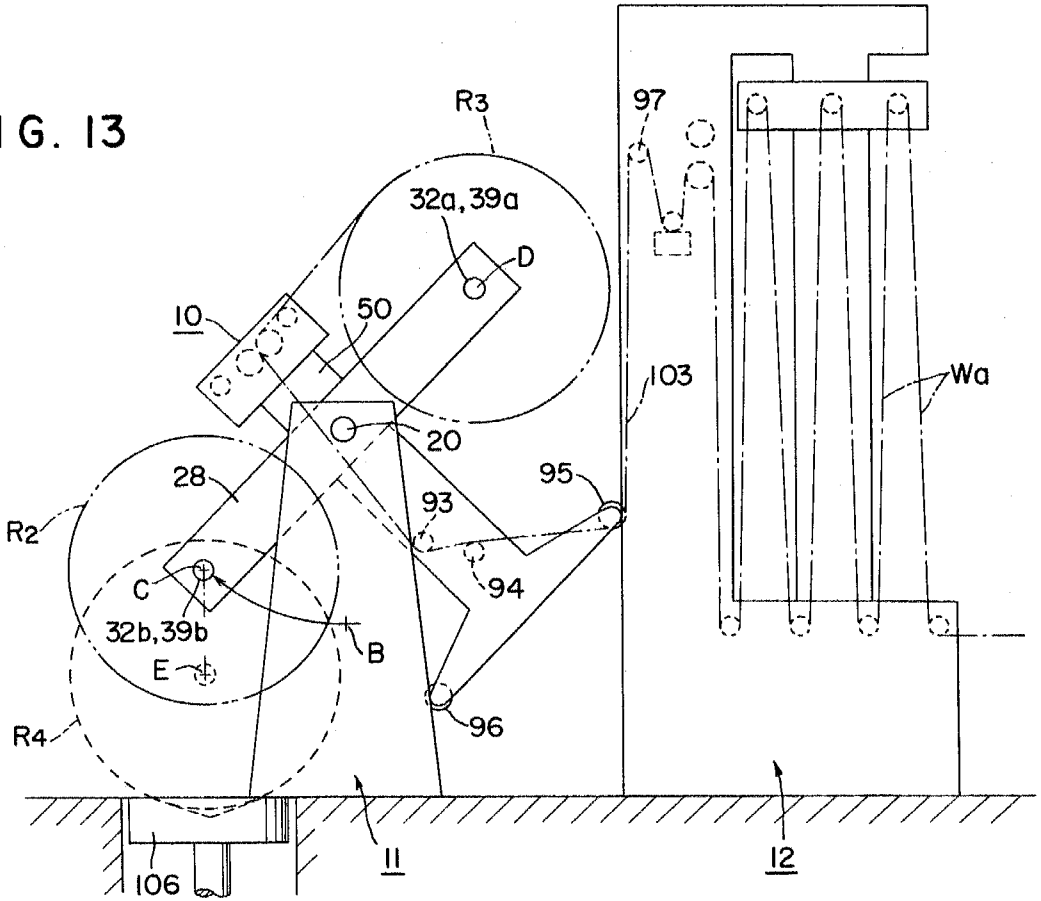

After starting the feeding of the web W3, the arms 28 are clockwisely rotated by the motor M to point C from point B shown in FIG. 13 for exchanging the used web roll R2 with a new web roll R4, and during this operation since the arms 28 are moved while maintained at substantially right angles with respect to the frame 50, the web W3 running in the web-pass-line 103 between the guide rollers 95 and 97 does not contact to the web roll R3.

The manner for exchanging the used web roll R2 with the new web roll R4 is substantially the same as that described hereinbefore in relation to the exchange of the web roll R1. Namely, when the central shaft R2*a* of the web roll R2 reaches point C, the air piston-cylinder assemblies C2 operate to draw back their piston rods 30*a* thereby disengaging the push members 32*b* and 39*b* from the central hollow shaft R2*a* of the web roll R2. The web roll lifter 106 now carrying the web roll R4 is raised until the hollow shaft of the web roll R4 reaches point E to point C shown in FIG. 13 and when the web roll R4 reaches point C, the piston-cylinder assembly C2 operates to move the movable sleeve 33, i.e. push members 32*b* and 39*b*, thereby to support the central shaft of the web roll R4 at the both ends thereof. Thereafter, the web roll lifter 106 is lowered.

After mounting the web roll R4 to the arms 28 at point C in FIG. 13, the motor M again operates to rotate counter-clockwisely the arms 28, i.e. the web roll R4, to point B from point C, where the web roll R3 now being payed out is positioned vertically above the web roll R4. The leading end of the web R4 applied with the adhesive is then attracted by the nip roller 54*b* as shown in FIG. 14E to prepare the next web splicing step.

In the foregoing description regarding the embodiment according to this invention, when it is required to exchange the web rolls R1 and R2 with the web rolls R3 and R4, respectively, it is necessary to limit the direction of rotation and angles of the arms 28. Electric circuit means for limiting the direction of rotation and angles will be described hereunder in conjunction with FIG. 15.

Figure 15:
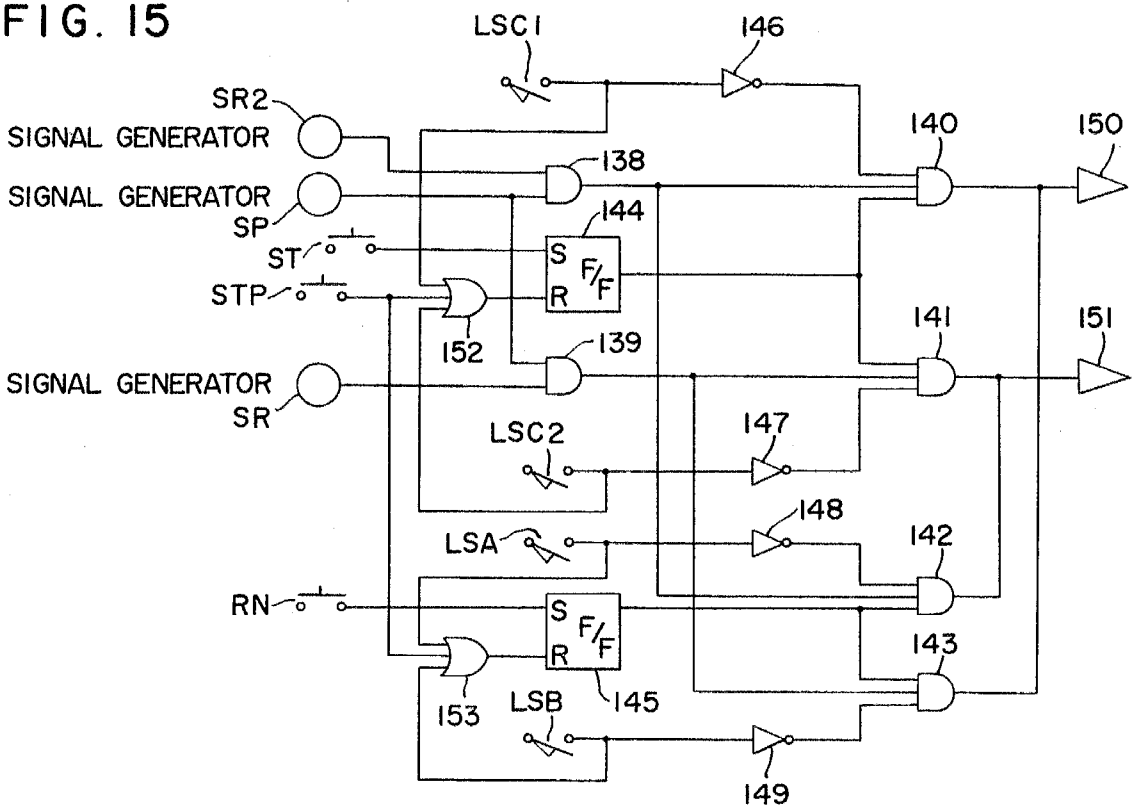
FIG. 15 shows a circuit diagram for operating the web roll holding arm of the web splicing and feeding apparatus shown in FIG. 1.

As shown in FIG. 15, a limit switch LSC1 is closed at the time when the web roll R1 (R3) reaches point C by the counter-clockwise rotation of the arms 28 and a limit switch LSA is closed at the time when the web roll R1 (R3) returns to point A by the clockwise rotation of the arms 28. A limit switch LSC2 is closed at the time when the web roll R2 (R4) reaches point C by the clockwise rotation of the arms 28 and a limit switch LSB is closed at the time when the web roll R2 (R4) is returned to point B by the counterclockwise rotation of the arms 28. These limit switches are operated by cam means, not shown, secured to the rotary shaft 20.

A signal generator SR1 detects the fact that the web W1 has been fed from the web roll R1 and generates a signal regarding this detection and a signal generator SR2 detects the fact that the web W2 has been fed from the web roll R2 and generates a signal regarding this detection. A signal generator SP generates a signal at the time when the web working machine is in operation.

In a case where the arms 28 and the frame 50 are positioned as shown in FIG. 11 and where web W2 of the web roll R2 is now being fed, in order to exchange the used web roll R1 with a new web roll R3 laid on the lifter 106, a push button switch ST is depressed to rotate the arms 28. A flip-flop circuit 144 is then enabled to produce a signal which is applied to one inputs of AND gate circuits 140 and 141.

Meanwhile, when the web W2 of the web roll R2 is fed to the web working machine, signals from the signal generators SR2 and SP are applied to an AND gate circuit 138, the output of which is applied to another input of the AND gate circuit 140. At this time, since the limit switch LSC1 is not closed, the output of a NOT gate circuit 146 is applied to another input of the AND gate circuit 140. The AND gate circuit 140 is thus enabled to generate a signal which is supplied to driving means 150 to drive counter-clockwisely the motor M.

When the counter-clockwise rotation of the motor M rotates the arms 28 from point A to point C, the limit switch LSC1 is closed and the NOT gate circuit 146 does not operate. Thus, the motor M stops and a signal from the limit switch LSC1 is applied to the reset terminal R of the flip-flop circuit 144 through an OR circuit 152 thereby to clear the memory stored in the flip-flop circuit 144.

When a push button RN is depressed after mounting the web roll R3 at point C, a signal is applied to the set terminal S of a flip-flop circuit 145 and its output is applied to one input of an AND gate circuit 142. At this time, the limit switch LSA is not operated, so that a signal from a NOT gate circuit 148 is applied to another input of the AND gate circuit 142. In the meantime, since signals from the signal generators SR2 and SP are sent to the AND gate circuit 138, the AND gate circuit 142 receives the output from the AND gate circuit 138 whereby driving means 151 is operated by the output of the AND gate circuit 142 thereby operating the motor M to rotate the arms 28 clockwisely to point A from point C. When the hollow shaft of the web roll R3 reaches point A, the limit switch LSA is closed and the NOT gate circuit 148 is disenabled. The AND gate circuit 142 is also disenabled to stop motor M. Then, a signal from the limit switch LSA is applied to a reset terminal R of the flip-flop circuit 145 through an OR gate circuit 153 thereby clearing the memory stored in the flip-flop circuit 145. In this manner the web roll R3 is brought to the working position to bond the web W3 to the web W2.

When it is required to exchange the web roll R2 with the new web roll R4, the push button switch ST is depressed. Then a signal is applied to the set terminal S of the flip-flop circuit 144 to enable the same and the output thereof is applied to input terminals of AND gate circuits 140 and 141. At this time, since the web roll R1 had already been exchanged with the web roll R3, namely, the web of the web roll R3 is now being fed, the signal generator SR1 operates and the signal generator SP also operates when the web working machine operates, signals from these signal generators are applied to the inputs of an AND gate circuit 139 and the output thereof is applied to inputs of AND gate circuits 141 and 142. However, the limit switch LSC2 has not been closed, so that the output from a NOT gate circuit 147 is applied to another input of the AND gate circuit 141 to enable the same. The output of the AND gate circuit 141 actuates the driving means 151 to rotate the motor M clockwisely, thereby rotating the arms 28, i.e. web roll R2, to point C from point B. When the arms 28 reaches point C, the limit switch LSC 2 is closed and the NOT gate circuit 147 is disenabled, whereby the motor M is stopped to stop the rotation of the arms 28. At the same time, the output of the limit switch LSC2 is applied to the reset input terminal R of the flip-flop circuit 144 through the OR gate circuit 152 thereby to clear the memory stored in the flip-flop circuit 144.

Under a condition wherein the web roll R4 is firmly supported by the push members **32*b* and 39*b*, when the push button RN is depressed, a signal is applied to the set terminal S of the flip-flop circuit 145 and its output is applied to one input terminals of the AND gate circuits 142 and 143. At this time, since the limit switch LSB is not closed, the NOT gate circuit 149 is enabled to supply its output to one input terminal of the AND gate circuit 143. Furthermore, since signals from the signal generators SR1 and SP are applied to the AND circuit 139, this AND gate circuit is enabled to apply its output to one input of the AND circuit 143. In addition to these outputs, a signal from the push button switch RN is applied to the AND circuit 143 via the flip-flop circuit 145. Thus, the AND circuit 143 is enabled to operate the driving means 150. Thus the motor M operates to rotate the arms 28 counter-clockwisely from point C so as to move the web roll R4 to point B. When the arms 28 reaches the point B, the limit switch LSB is closed to disenable the NOT gate circuit 149. Thus, the AND gate circuit 143 is also disenabled and the motor M stops. At this moment, the memory stored in the flip-flop circuit 145 is cleared by a signal through the OR circuit 153**.

According to the arrangement described above, in a case where any accident requiring the stoppage of the operation of the arms 28 occurs, the push button STP for stopping the rotation of the arms 28 is depressed to apply a signal to the reset terminals R of the flip-flop circuits 144 and 145 through the OR gate circuits 152 and 153 to clear these flip-flop circuits thereby stopping the operation of the arms 28.

As can be understood from the foregoing description, at the time when the web rolls are to be exchanged, the direction of rotation of the arms is automatically determined by depressing the push button switch ST and the arms are rotated in the direction thus judged until they reach point C, and after the web rolls have been exchanged, the fitted new web roll would be rotated in a direction determined by the depression of the push button switch RN until the new web roll reaches the point A or B and stops there. Therefore, the arms are automatically rotated in a predetermined direction without contacting the web now in use and the web roll.

As in apparent from the foregoing description, according to this invention, since the web roll holding arms are reversibly rotated −y an angle of about 180° between the points C and D, electric power or pneumatic pressure can easily be fed to piston-cylinder assemblies C1 and C2 for moving the push members 32 and 39 by using a relatively simple mechanism in comparison with a mechanism of a prior art in which a slip ring or rotary joint is constantly rotated in one direction. Moreover, the web roll is attached to the web roll holding arms at only the point C, so that the attachment can be done safely and positively. Thus, the automatic web splicing and feeding apparatus of this invention can perform the web splicing operation with high accuracy.

We claim:

1. An automatic web splicing and feeding apparatus comprising:

a web feeder including supporting means, a rotary shaft with both ends thereof rotatably supported by said supporting means, a pair of spaced apart web roll holding arms with their central portions fitted to said rotary shaft, two pairs of push members secured to opposing surfaces of said arms near the extreme ends thereof for detachably holding both ends of hollow shafts of two web rolls, lever members mounted on said rotary shaft on the outside of said arms, automatic web splicing means supported by said lever members for bonding the trailing end of the web of one of said two web rolls to the leading end of the web of the other web roll, and means for driving said rotary shaft so as to move one of said two pairs of push members to a web working position;

web storing means for storing said web supplied from said web splicing means and for feeding said web therefrom to web working means located downstream of said web storing means; and means for determining direction and angle of rotation of said rotary shaft.

2. The automatic web splicing and feeding apparatus according to claim 1 wherein said web roll holding arms are slidably fitted along said rotary shaft so as to adjust the spacing therebetween.

3. The automatic web splicing and feeding apparatus according to claim 1 wherein each of said lever members extends perpendicularly to said web roll holding arm, one end of said lever member supporting said automatic web splicing means and the other end supporting a group of guide rollers for leading said web.

4. The automatic web splicing and feeding apparatus according to claim 1 wherein said web splicing means comprises a pair of nip rollers which are brought into contact with each other for splicing two webs of said two web rolls, each of said nip rollers being provided with means for attracting said web with reduced pressure.

5. The automatic web splicing and feeding apparatus according to claim 1 wherein said web splicing means further comprises cutting means for cutting the trailing end of one of said webs subsequent to splicing, and means for bringing said cutting means to an operative position from an inoperative position.

6. The automatic web splicing and feeding apparatus according to claim 1 wherein said web splicing means further comprises means for applying an adhesive to the leading end of the web to be bonded to the trailing end of the web now being payed out.

7. The automatic web splicing and feeding apparatus according to claim 1 wherein said web storing means is a festoon loop type web storing device including a series of guide rollers located in a common horizontal plane, a vertically movable member located above said series of guide rollers, and dancing rollers secured to said movable member in a common horizontal plane, and said web is stretched in a zig-zag form about said guide rollers and said dancing rollers to form a festoon type web feeding loops.

8. The automatic web splicing and feeding apparatus according to claim 1 wherein a used web roll is always exchanged with a new web roll at a predetermined working position.

9. The automatic web splicing and feeding apparatus according to claim 8 wherein said new web roll is rotated by a predetermined angle to a position where web splicing is carried out after said new web roll has been exchanged with the used web roll.

* * * * *